United States Patent [19]

Kennedy et al.

[11] Patent Number: 4,820,081

[45] Date of Patent: Apr. 11, 1989

[54] HEAD SEAL FOR A MINE STOPPING

[76] Inventors: John M. Kennedy; William R. Kennedy, both of P.O. Box 38, Taylorville, Ill. 62568

[21] Appl. No.: 145,213

[22] Filed: Jan. 19, 1988

[51] Int. Cl.[4] ..... E21F 1/14

[52] U.S. Cl. ..... 405/132; 52/126.3; 405/150

[58] Field of Search ..... 405/132, 150, 151, 152, 405/153, 303; 52/126.3, 126.4, 241; 98/50

[56] References Cited

U.S. PATENT DOCUMENTS

| | | | |
|---|---|---|---|
| 2,729,064 | 1/1956 | Kennedy et al. | 405/132 |
| 4,109,430 | 8/1978 | Fuller | 52/241 X |
| 4,478,535 | 10/1984 | Kennedy et al. | 405/132 |
| 4,483,642 | 11/1984 | Kennedy et al. | 405/132 |
| 4,484,837 | 11/1984 | Kennedy et al. | 405/150 |
| 4,695,035 | 9/1987 | Kennedy et al. | 405/132 X |

*Primary Examiner*—Dennis L. Taylor

*Attorney, Agent, or Firm*—Senniger, Powers, Leavitt and Roedel

[57] ABSTRACT

A mine stopping comprising a plurality of panels adapted to extend in side-by-side relation from the floor to the roof of a passageway in a mine. Each panel comprises a first elongate member constituting the lower member of the panel and a second elongate member constituting an upper member of the panel. Each member has a web and flanges at opposite sides of the web, each flange having an inturned portion at its outer edge extending generally parallel to its web. One of the members has a telescoping sliding fit in the other. The upper member of each panel has a head at its upper end, the head being generally of channel shape in transverse cross section having a web and two flanges. A sealing member of compressible material pocketed between the two flanges of the head extends up out of the upper end of the upper member for pressure engagement with the roof. The sealing member compresses during pressure engagement with the roof and exerts lateral expansive forces against portions of the flanges of the head symmetric about a vertical plane extending in a side-to-side direction with respect to the panel midway between the web of the upper member and the inturned portions of the flanges. The symmetry of the head results in equivalent lateral expansive forces exerted against the flanges of the head during compression thereby to avoid canting of the panel with respect to the vertical plane.

5 Claims, 1 Drawing Sheet

HEAD SEAL FOR A MINE STOPPING

BACKGROUND OF THE INVENTION

This invention relates to a mine stopping and, more particularly, to a mine stopping comprising a plurality of metal panels adapted to be installed side-by-side to stop a passage in a mine.

Mine stoppings are widely used in mines to stop the flow of air in passages in the mines, a stopping typically being installed at the entrance of a passage to block flow of air therethrough. This invention especially involves an improvement on the mine stopping of the type such as is shown, for example, in U.S. Pat. No. 2,729,064 and co-assigned U.S. Pat. No. 4,483,642 comprising a plurality of elongate extensible panels extending vertically in side-by-side relation from the floor to the roof of a passageway in a mine. Each panel has a head and a foot adapted for pressure engagement with the roof and floor of the passageway when the panel is extended during installation. To provide an effective seal, the head of each panel typically has a resilient sealing member therein which is compressed during extension of the panel to seal against the roof. A problem encountered with the prior mine stopping is that the head has been asymmetrically formed, resulting in unequal forces exerted by the sealing member on opposite sides of the head during compression of the sealing member. This has caused the panel to list or cant off vertical during installation.

SUMMARY OF THE INVENTION

Among the several objects of the invention may be noted the provision of an improved head seal design for a mine stopping of the aforementioned type; the provision of such a head seal which is formed in such a way that the forces exerted by a sealing member on the head during installation are substantially balanced with respect to the central vertical plane of the panel thereby to avoid canting of the panel during installation of the panel; and the provision of such a head seal which is economical to manufacture. Other objects and features will be in part apparent and in part pointed out hereinafter.

Briefly, the improved head seal of this invention is used in connection with a mine stopping of the type comprising a plurality of extensible panels adapted to extend in side-by-side relation from the floor to the roof of a passageway in a mine, each panel comprising a first elongate member constituting a lower member of the panel adapted for engagement of its lower end with the floor of the passageway, and a second elongate member constituting an upper member of the panel adapted for engagement of its upper end with the roof of the passageway, each of said panel members being a sheet metal member of channel shape in cross section having a web and flanges at opposite sides of the web, each flange having an inturned portion at its outer edge extending generally parallel to the web, one of said members having a telescoping sliding fit in the other with the webs of the members in engagement. The improved head seal comprises a head in the form of a sheet metal member at the upper end of an upper member of each panel, the head having a length less than the distance between the flanges of the upper member and greater than the distance between the inner edges of said inturned portions of the flanges. The head is generally of channel shape in transverse cross section having a web of a width less than the distance between the web of the upper panel member and said inturned portions of the flanges and fitting between the web of the upper member and said inturned portions, a first flange extending up from one edge of the web of the head spaced from the inside face of the web of the upper panel member, and a second flange extending up from the other edge of the web generally adjacent said inturned portions of the flanges. The heat seal also includes a sealing member of compressible material pocketed in the head between said first and second flanges and extending up out of the upper end of said upper member of the panel for pressure engagement with the roof when the upper and lower members of the panel are telescopically extended relative to one another. The sealing member is compressible during pressure engagement with the roof and is adapted to exert 15. lateral expansive forces against portions of said first and second flanges of the head. These latter portions of the first and second flanges of the head are substantially symmetric about a vertical plane extending in side-to-side direction with respect to the panel midway between the web of the upper member of the panel and the inturned portions of the flanges of the upper member of the panel whereby the lateral expansive force exerted during compression by said sealing member against the first flange is approximately equal to the lateral expansive force exerted against the second flange thereby to avoid canting of the panel with respect to said vertical plane.

BRIEF DESCRIPTION OF THE DRAWING

Corresponding numbers refer to corresponding parts throughout the several views of the drawings.

DESCRIPTION OF THE PREFERRED EMBODIMENT

Figure 1:
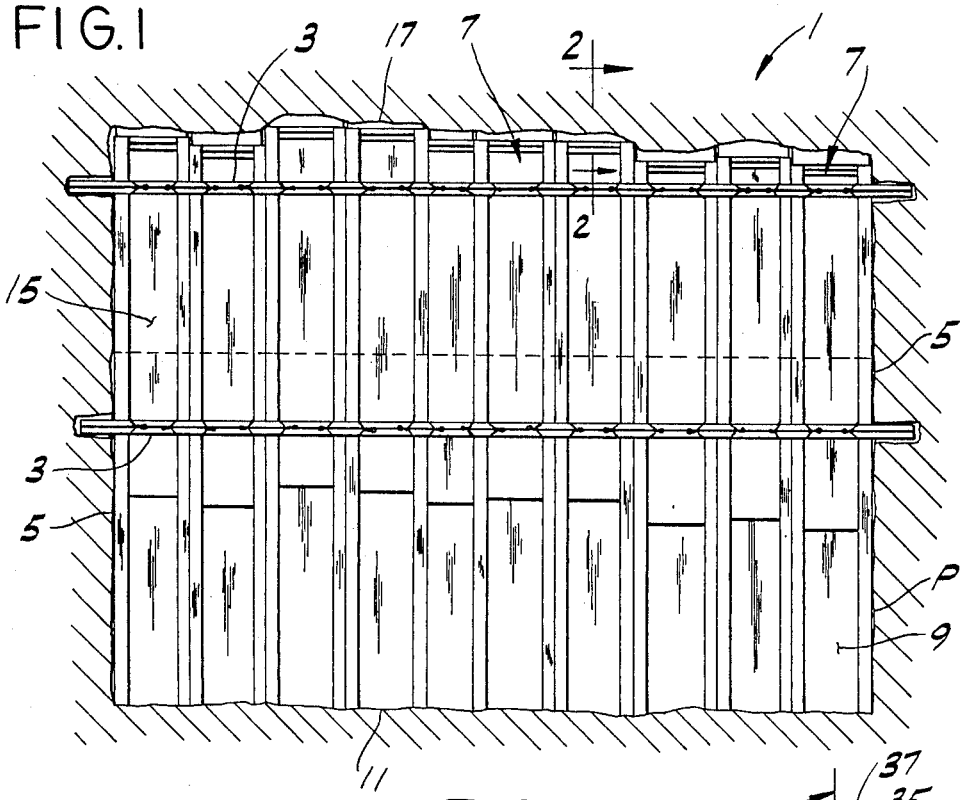
FIG. 1 is an elevation of a mine stopping installed in a passageway in a mine.

Referring to the drawings, there is generally indicated at 1 a mine stopping of this invention installed in passageway P in a mine comprising bars 3 adapted to extend substantially horizontally between ribs 5 at opposite sides of the passageway, and a plurality of elongate extensible panels 7 adapted to extend vertically in side-by-side relation from the floor to the roof of the passageway.

Figure 2:
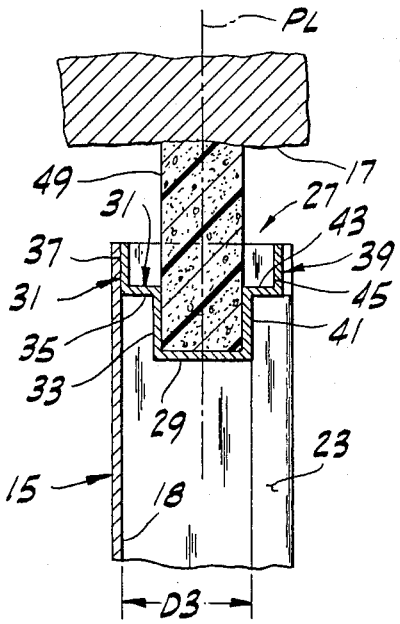
FIG. 2 is an enlarged vertical section taken on line 2——2 of FIG. 1 showing a head seal of the present invention.
Figure 4:
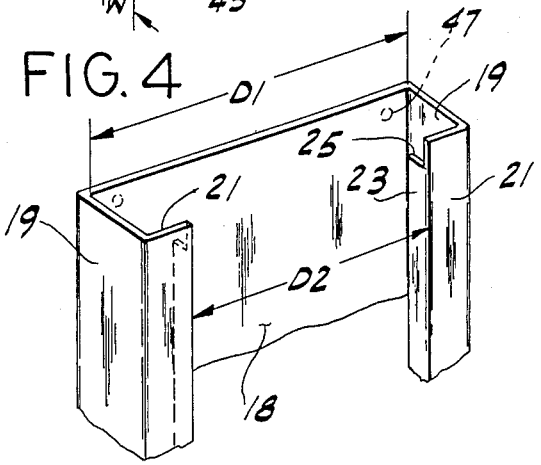
FIG. 4 is a perspective of the upper end of a panel of the mine stopping.

Each of the panels 7 comprises a first elongate member 9 constituting a lower member of the panel adapted for engagement of its lower end with the floor 11 of the passageway, and a second elongate member 15 constituting an upper member of the panel adapted for engagement of its upper end with the roof 17 of the passageway (as shown in FIG. 2). Each panel member 9, 15 is a sheet metal member of channel shape in cross section having a web 18 and flanges both designated 19 at opposite sides of the web (see FIG. 4). Each flange has an inturned portion 21 at its outer edge extending generally parallel to the web and a lip 23 at the inner edge of the inturned portion extending toward the web. The upper panel member 15 and lower panel member 9 have a telescopic fit, the webs 18 of the members being in sliding engagement. The lips 23 of each upper panel member 15 terminate short of the upper end of the upper member thereby providing a notch 25 at the upper end of each lip of the upper panel member.

Figure 3:
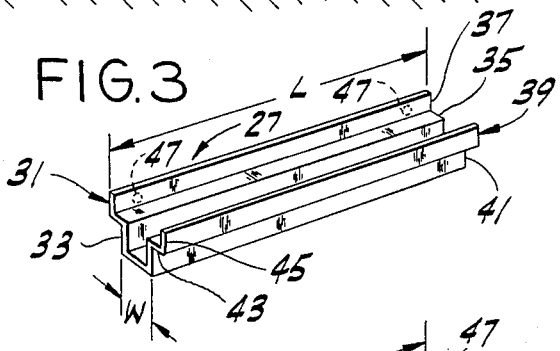
FIG. 3 is a perspective of a head of the head seal.

The upper panel member 15 has a head 27 at its upper end comprising a sheet metal member having a length L less than the distance D1 between the flanges 19 of the upper panel member and greater than the distance D2 between the lips 23 of the upper panel member. The head is generally of channel shape in transverse cross section having a web 29 of a width W less than the distance D3 between the web 18 of the upper panel member and the edges of the lips 23 and fits between the web 18 and the lips 23. The head 27 further has a first flange 31 extending up from one edge of the web of the head having a lower generally vertical portion 33 extending up spaced from the inside face of the web 18 of the upper panel member, an intermediate generally horizontal portion 35 extending from the upper edge of the lower portion 33 toward the inside face of the web 18 of the upper member of the panel, and an upper generally vertical portion 37 extending up from the outer edge of the intermediate portion adjacent the inside face of the upper member of the panel. A second flange 39 extends up from the other edge of the web having a lower generally vertical portion 41 extending up adjacent the outer edges of the lips 23 of the upper panel member 15 of the panel, an intermediate generally horizontal portion 43 extending out from the upper edge of the lower portion 41 into the notches 25 over the upper edges of the lips 23, and an upper generally vertical portion 45 extending up from the outer edge of the intermediate portion 43 on the inside of the inturned portions 21 of the flanges 19 of the upper member of the panel (see FIGS. 2 and 3). The head 27 is secured to the upper panel member 15 at its upper end with the ends of the head spaced from the side flanges 19 of the upper panel member by suitably attaching the upper portion 37 of the first flange 31 of the head to the web 18 of the upper panel member at the upper corners of the first flange 31, the areas of attachment being generally designated 47.

As illustrated, a sealing member 49 is pocketed in the head 27 of each upper panel member 15. The sealing member is generally rectangular in cross section and sized for a relatively close fit between the lower vertical portions 33, 41 of the first and second flanges 31, 39 of the head. The sealing member extends up out of the upper end of said upper member for engagement with the roof 17 of the passageway. The sealing member comprises a block of self-extinguishing expanded polystyrene (other suitable material may be used) which readily conforms to the contour of the roof of the passageway to form a seal at the top of the panel when pressed into engagement with the roof. The sealing member is preferably resilient so that, when compressed against the roof, it not only conforms to the roof contour but also has a spring-back or expansion effect to maintain the stopping seal, despite occurrences such as concussion effects from blasting in the mine that might otherwise tend to break the seal. Resilient materials other than polystyrene may be used. It is also contemplated that a sealing member backed by springs may be used and it is intended that "resilient sealing member" cover this.

It is important to note that the head 27 and sealing member 49 pocketed therein are symmetric about a vertical plane PL extending in a side-to-side direction with respect to the panel midway between the web 18 of the upper panel member 15 and the inturned portions 21 of the flanges of the upper member of the panel. As a result, the lateral expansive forces exerted during compression by the sealing member against the lower vertical portion 33 of the first flange 31 are approximately equal to the lateral expansive forces exerted against the lower vertical portion 41 of the second flange 39 thereby to avoid canting of the panel with respect to plane PL.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A mine stopping of the type comprising a plurality of extensible panels adapted to extend in side-by-side relation from the floor to the roof of a passageway in a mine, each panel comprising a first elongate member constituting a lower member of the panel adapted for engagement of its lower end with the floor of the passageway, and a second elongate member constituting an upper member of the panel adapted for engagement of its upper end with the roof of the passageway, each of said panel members being a sheet metal member of channel shape in cross section having a web and flanges at opposite sides of the web, each flange having an inturned portion at its outer edge extending generally parallel to the web, one of said members having a telescoping sliding fit in the other with the webs of the members in engagement, the improvement comprising a head seal comprising:

a head in the form of a sheet metal member at the upper end of an upper member of each panel, said head having a length less than the distance between the flanges of the upper member and greater than the distance between the inner edges of said inturned portions of the flanges;

the head being generally of channel shape in transverse cross section having a web of a width less than the distance between the web of the upper panel member and said inturned portions of the flanges and fitting between the web of the upper member and said inturned portions, a first flange extending up from one edge of the web of the head spaced from the inside face of the web of the upper panel member, and a second flange extending up from the other edge of the web generally adjacent said inturned portions of the flanges; and a sealing member of compressible material pocketed in the head between said first and second flanges and extending up out of the upper end of said upper member of the panel for pressure engagement with the roof when the upper and lower members of the panel are telescopically extended relative to one another, the sealing member being compressible during said pressure engagement with the roof and being adapted to exert lateral expansive forces against portions of said first and second flanges of the head;

said portions of the first and second flanges of the head being substantially symmetric about a vertical plane extending in side-to-side direction with respect to the panel midway between the web of the upper member of the panel and the inturned portions of the flanges of the upper member of the panel whereby the lateral expansive force exerted during compression by said sealing member against the first flange is approximately equal to the lateral expansive force exerted against the second flange thereby to avoid canting of the panel with respect to said vertical plane.

2. A mine stopping as set forth in claim 1 wherein said head and sealing member pocketed therein are substantially symmetric about said vertical plane.

3. A mine stopping as set forth in claim 2 wherein said first flange of the head has a lower portion extending up from said one edge of the web spaced from the inside face of the upper member of the panel, an intermediate portion extending from the upper edge of the lower portion toward the inside face of the upper member of the panel, and an upped portion extending up from the outer edge of the intermediate portion on the inside face of the upper member of the panel, said second flange of the head having a lower portion extending up from said other edge of the web spaced from the inturned portions of the flanges at opposite sides of the web of the upper member of the panel, an intermediate portion extending from the upper edge of the lower portion toward said inturned flange portions, and an upper portion extending up from the outer edge of the intermediate portion on the inside face of said inturned flange portions.

4. A mine stopping as set forth in claim 3 wherein said sealing member is sized for a relatively close fit between the lower portions of the first and second flanges of the head and is adapted to exert said lateral expansive forces against said lower portions.

5. A mine stopping as set forth in claim 4 further comprising a lip at the inner edge of each inturned portion of the flanges of the upper and lower members of the panels, said lip extending inwardly toward the web of the panel member, the lips of the upper member of each panel terminating short of the upper end of the upper member and thereby providing notches at the upper ends of the lips, the lower portion of the second flange of the head extending up adjacent the outer edges of the lips of the upper member of the panel, the intermediate portion of the second flange of the head extending into said notches over the lips, and said upper portion of the second flange of the head extending up on the inside of said inturned portions of the flanges of the upper member of the panel.

* * * * *